US010718039B2

(12) United States Patent
Cha et al.

(10) Patent No.: US 10,718,039 B2
(45) Date of Patent: Jul. 21, 2020

(54) HIGH STRENGTH SPRING STEEL HAVING EXCELLENT CORROSION RESISTANCE

(71) Applicant: Hyundai Motor Company, Seoul (KR)

(72) Inventors: Sung Chul Cha, Seoul (KR); Soon Woo Kwon, Gyeonggi-Do (KR); Hyuk Kim, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 87 days.

(21) Appl. No.: 15/342,811

(22) Filed: Nov. 3, 2016

(65) Prior Publication Data

US 2017/0298486 A1 Oct. 19, 2017

(30) Foreign Application Priority Data

Apr. 15, 2016 (KR) ..... 10-2016-0046130

(51) Int. Cl.

| | |
|---|---|
| ***C22C 38/52*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/34*** | (2006.01) |
| ***C22C 38/06*** | (2006.01) |

(Continued)

(52) U.S. Cl.

CPC ..... *C22C 38/52* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search

CPC ... C22C 38/001; C22C 38/002; C22C 38/005; C22C 38/02; C22C 38/04; C22C 38/06; C22C 38/34; C22C 38/42; C22C 38/44; C22C 38/46; C22C 38/48; C22C 38/50; C22C 38/52

See application file for complete search history.

(56) References Cited

U.S. PATENT DOCUMENTS 4,770,721 A 9/1988 Yamamoto et al.
5,776,267 A * 7/1998 Nanba ..... C22C 38/44 148/328

(Continued)

FOREIGN PATENT DOCUMENTS

CN 102586692 A 7/2012
EP 2947168 A1 11/2015

(Continued)

OTHER PUBLICATIONS

Villasenor-Ochoa, H. "Engineering Fundamentals Refresh: Strength vs Stiffness vs Hardness", taken from https://www.fictiv.com/hwg/design/engineering-fundamentals-refresh-strength-vs-stiffness-vs-hardness, 12 pages (Year: 2017).*

(Continued)

*Primary Examiner* — Ngoc-Yen Nguyen

(74) *Attorney, Agent, or Firm* — Mintz Levin Cohn Ferris Glovsky and Popeo, P.C.; Peter F. Corless

(57) ABSTRACT

Disclosed herein is a steel composition with improvement in tensile strength and fatigue life, which can be used for a vehicle part such as a vehicle suspension system.

7 Claims, 2 Drawing Sheets

(51) Int. Cl.

| | |
|---|---|
| ***C22C 38/04*** | (2006.01) |
| ***C22C 38/02*** | (2006.01) |
| ***C22C 38/00*** | (2006.01) |
| ***C22C 38/50*** | (2006.01) |

(56) References Cited

U.S. PATENT DOCUMENTS

| | | | | |
|---|---|---|---|---|
| 6,277,220 | B1 * | 8/2001 | Hamada | C21C 7/0075 148/595 |
| 6,322,747 | B1 | 11/2001 | Fukuzumi et al. | |
| 7,789,974 | B2 | 9/2010 | Hashimura et al. | |
| 2008/0279714 | A1 | 11/2008 | Hashimura et al. | |
| 2008/0308195 | A1 * | 12/2008 | Yoshihara | C21D 8/06 148/547 |
| 2009/0007998 | A1 | 1/2009 | Kochi et al. | |
| 2009/0065105 | A1 | 3/2009 | Kochi et al. | |
| 2009/0092516 | A1 | 4/2009 | Hashimura et al. | |
| 2009/0205753 | A1 | 8/2009 | Hashimura et al. | |
| 2010/0028196 | A1 | 2/2010 | Hashimura et al. | |
| 2013/0127100 | A1 | 5/2013 | Ishida et al. | |
| 2015/0369322 | A1 * | 12/2015 | Sugimura | C22C 38/00 267/182 |
| 2016/0053352 | A1 | 2/2016 | Aono et al. | |
| 2017/0044633 | A1 * | 2/2017 | Hashimura | B22D 11/115 |
| 2017/0298486 | A1 | 10/2017 | Cha et al. | |

FOREIGN PATENT DOCUMENTS

| | | | |
|---|---|---|---|
| JP | H05-148581 | A | 6/1993 |
| JP | H05-214489 | A | 8/1993 |
| JP | H10-110247 | A | 4/1998 |
| JP | 2001-181788 | A | 7/2001 |
| JP | 2003-105485 | A | 4/2003 |
| JP | 2006-028599 | A | 2/2006 |
| JP | 2006-183137 | A | 7/2006 |
| JP | 2007-224413 | A | 9/2007 |
| JP | 2012-072492 | A | 4/2012 |
| JP | 5200540 | B2 | 6/2013 |
| JP | 2014-136810 | A | 7/2014 |
| JP | 2015-120940 | A | 7/2015 |
| KR | 10-0213542 | B1 | 8/1999 |
| KR | 10-2002-0083181 | A | 11/2002 |
| KR | 2008-0009699 | A | 1/2008 |
| KR | 2008-0009713 | A | 1/2008 |
| KR | 2008-0057205 | A | 6/2008 |
| KR | 100851083 | B1 | 8/2008 |
| KR | 10-2008-0111688 | A | 12/2008 |
| KR | 10-2009-0071163 | A | 7/2009 |
| KR | 2010-0004352 | A | 1/2010 |
| KR | 10-2010-0019603 | A | 2/2010 |
| KR | 10-0968938 | B1 | 7/2010 |
| KR | 2010-0077250 | A | 7/2010 |
| KR | 10-2010-0103243 | | 9/2010 |
| KR | 10-2011-0075318 | A | 7/2011 |
| KR | 10-1401625 | B1 | 6/2014 |
| KR | 2015-0093210 | A | 8/2015 |
| SU | 1184867 | A1 | 10/1985 |
| WO | 99/67437 | A1 | 12/1999 |
| WO | 2015-162928 | A1 | 10/2015 |

OTHER PUBLICATIONS

Bossard, "Difference Between Hardness and Strength in Steel", taken from https://web.archive.org/web/20160805211012/https://provenproductivity.com/difference-between-hardness-and-strength-in-steel/, 1 page (Year: 2016).*

Extended European Search Report for European Patent Application No. 16175227.4, dated May 2, 2017, 11 pages.

Office Action for U.S. Appl. No. 15/342,636, dated Jul. 26, 2018, 31 pages.

Bossard, "Difference Between Hardness and Strength in Steel", taken from https://web.archive.org/web/20160805211012/https://provenproductivity.com/difference-between-hardness-and-strength-in-steel/, 1 page (2016).

H. Villasenor-Ochoa, "Engineering Fundamentals Refresh: Strength vs Stiffness vs Hardness", taken from https://www.fictiv.com/hwg/design/engineering-fundamentals-refresh-strength-vs-hardness, Feb. 15, 2017, 12 pages.

* cited by examiner

HIGH STRENGTH SPRING STEEL HAVING EXCELLENT CORROSION RESISTANCE

CROSS REFERENCE TO RELATED APPLICATION

The present application claims priority to Korean Patent Application No. 10-2016-0046130, filed Apr. 15, 2016, the entire contents of which is incorporated herein for all purposes by this reference.

TECHNICAL FIELD

The present invention relates to a steel composition having substantially improved strength and corrosion resistance. In addition, the steel composition may be suitably used in a vehicle suspension system, with substantial improvement in tensile strength and fatigue life.

BACKGROUND OF THE INVENTION

Spring steel has been widely used in the manufacture of springs, prominently in vehicles and industrial suspension applications. For use in a car suspension system, spring steel is required to exhibit high fatigue strength.

Recently, weight reduction and high power have been required for vehicles with the aim of reducing exhaust emissions and improving fuel efficiency. Accordingly, the design of coil springs useful for engines or car suspension systems has been directed toward improving stress resistance.

Particularly, coil springs for use in vehicle suspension systems are required to have excellent strength because these parts continuously endure loads. Further, corrosion resistance should be fully considered because they are exposed to an external environment.

Such coil springs for car suspension systems have been usually made of spring steel including mainly of carbon (C), silicon (Si), manganese (Mn), and chromium (Cr) and having a tensile strength of about 1900 Mpa. Moreover, research has been conducted into an inclusion control technique in which kinds and contents of alloy elements are controlled to improve fatigue life.

The foregoing is intended merely to aid in the understanding of the background of the present invention, and is not intended to mean that the present invention falls within the purview of the related art that is already known to those skilled in the art.

SUMMARY OF THE INVENTION

In preferred aspect, the present invention provides a high-strength spring which features improved tensile strength by optimizing contents of molybdenum (Mo), nickel (Ni), vanadium (V), niobium (Nb), titanium (Ti), cobalt (Co), zirconium (Zr), and yttrium (Y) and improved fatigue strength under a corrosive environment by controlling inclusions formed therein.

In one aspect of the present invention, provided is a spring steel or its steel composition, which may be suitably used in a vehicle part such as a coil spring steel in a vehicle suspension system. Unless otherwise indicated hereinafter, the steel or steel composition may be used as a spring steel having substantially improved strength which can be used for a vehicle.

The steel composition may comprise: carbon (C) in an amount of about 0.4 to 0.9% by weight; silicon (Si) in an amount of about 1.3 to 2.3% by weight; manganese (Mn) in an amount of about 0.5 to 1.2% by weight; chromium (Cr) in an amount of about 0.6 to 1.2% by weight; molybdenum (Mo) in an amount of about 0.1 to 0.5% by weight; nickel (Ni) in an amount of about 0.05 to 0.8% by weight; vanadium (V) in an amount of about 0.05 to 0.5% by weight; niobium (Nb) in an amount of about 0.05 to 0.5% by weight; titanium (Ti) in an amount of about 0.05 to 0.3% by weight; cobalt (Co) in an amount of about 0.01 to 3% by weight; zirconium (Zr) in an amount of about 0.001 to 0.2% by weight; yttrium (Y) in an amount of about 0.01 to 1.5% by weight; copper (Cu) in an amount of about 0.3% by weight or less but greater than 0% by weight; aluminum (Al) in an amount of about 0.3% by weight or less but greater than 0% by weight; nitrogen (N) in an amount of about 0.03% by weight or less but greater than 0% by weight; oxygen (O) in an amount of about 0.003% by weight or less but greater than 0% by weight; iron (Fe) constituting remaining balance of the steel composition. Unless otherwise indicated herein, all % by weights based on the total weight of the steel composition.

Further provided is a steel or its composition that may consist essentially of, essentially consist of or consist of the components as described herein. For example, the steel composition may consist essentially of, essentially consist of, or consist of: carbon (C) in an amount of about 0.4 to 0.9% by weight; silicon (Si) in an amount of about 1.3 to 2.3% by weight; manganese (Mn) in an amount of about 0.5 to 1.2% by weight; chromium (Cr) in an amount of about 0.6 to 1.2% by weight; molybdenum (Mo) in an amount of about 0.1 to 0.5% by weight; nickel (Ni) in an amount of about 0.05 to 0.8% by weight; vanadium (V) in an amount of about 0.05 to 0.5% by weight; niobium (Nb) in an amount of about 0.05 to 0.5% by weight; titanium (Ti) in an amount of about 0.05 to 0.3% by weight; cobalt (Co) in an amount of about 0.01 to 3% by weight; zirconium (Zr) in an amount of about 0.001 to 0.2% by weight; yttrium (Y) in an amount of about 0.01 to 1.5% by weight; copper (Cu) in an amount of about 0.3% by weight or less but greater than 0% by weight; aluminum (Al) in an amount of about 0.3% by weight or less but greater than 0% by weight; nitrogen (N) in an amount of about 0.03% by weight or less but greater than 0% by weight; oxygen (O) in an amount of about 0.003% by weight or less but greater than 0% by weight; iron (Fe) constituting remaining balance of the steel composition.

In some embodiments, the steel suitably may have a tensile strength of about 2100 MPa or greater.

In some embodiments, the steel suitably may have a hardness of about 700 HV.

In some embodiments, the steel suitably may have a corrosion pit depth of about 15 μm or less.

In some embodiments, the steel suitably may have a fatigue life of about 280,000 cycles or greater as measured by a bending fatigue test.

In some embodiments, the steel suitably may have a fatigue life of about 28,000 cycles or greater as measured by a single corrosion fatigue life test.

In some embodiments, the steel suitably may have a fatigue life of about 400,000 cycles or greater as measured by a complex corrosion fatigue test.

In another aspect, the present invention may provide a vehicle part. Exemplary vehicle part may include a spring steel used in a suspension system in a vehicle.

Other aspects of the invention are disclosed infra.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
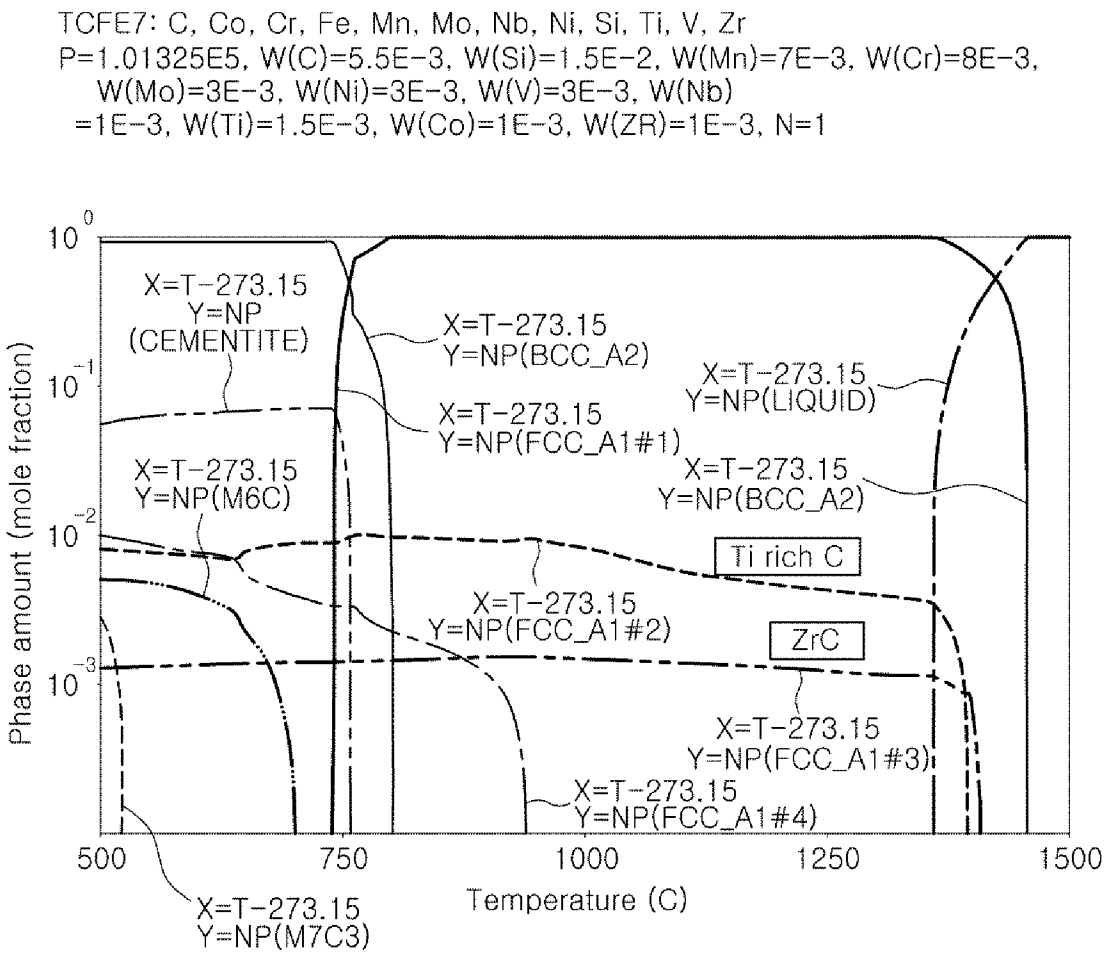
FIG. 1 is a graph showing the phase transformation of an exemplary steel based on a temperature change according to an exemplary embodiment of the present invention.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

For illustrative purposes, the principles of the present invention are described with reference to various exemplary embodiments. Although certain embodiments of the invention are specifically described herein, one of ordinary skill in the art will readily recognize that the same principles are equally applicable to, and can be employed in, other systems and methods. Before explaining the disclosed embodiments of the present invention in detail, it is to be understood that the invention is not limited in its application to the details of any particular embodiment shown.

In an exemplary embodiment, provided is a steel, or a steel composition which may be suitable for use as a coil spring steel in a vehicle engine. In particular, the steel composition may have improved properties such as tensile strength and fatigue strength as components and contents thereof may be optimized.

The spring steel according to an exemplary embodiment of the present invention may comprise: carbon (C) in an amount of about 0.4 to 0.9% by weight; silicon (Si) in an amount of about 1.3 to 2.3% by weight; manganese (Mn) in an amount of about 0.5 to 1.2% by weight; chromium (Cr) in an amount of about 0.6 to 1.2% by weight; molybdenum (Mo) in an amount of about 0.1 to 0.5% by weight; nickel (Ni) in an amount of about 0.05 to 0.8% by weight; vanadium (V) in an amount of about 0.05 to 0.5% by weight; niobium (Nb) in an amount of about 0.05 to 0.5% by weight; titanium (Ti) in an amount of about 0.05 to 0.3% by weight; cobalt (Co) in an amount of about 0.01 to 3% by weight; zirconium (Zr) in an amount of about 0.001 to 0.2% by weight; yttrium (Y) in an amount of about 0.01 to 1.5% by weight; copper (Cu) in an amount of about 0.3% by weight or less but greater than 0% by weight; aluminum (Al) in an amount of about 0.3% by weight or less but greater than 0% by weight; nitrogen (N) in an amount of about 0.03% by weight or less but greater than 0% by weight; oxygen (O) in an amount of about 0.003% by weight or less but greater than 0% by weight; iron (Fe) constituting remaining balance of the steel composition, all the % by weights are based on the total weight of the steel composition.

Below, reasons for numerical limitations of the components in the composition according to the present invention will be described. Unless described otherwise, the unit % by weight given in the following description is based on the total weight of the steel or steel composition.

Carbon (C) as used herein may be included in an amount of about 0.4 to 0.9% by weight. The strength of steel may increase with increased carbon content. When the carbon content is less than about 0.4% by weight, the steel composition may have only slightly increases in strength because of insufficient quenching properties upon heat treatment. On the other hand, when the carbon content is greater than about 0.9% by weight, the formation of the martensitic phase may be induced upon quenching, thereby resulting in decreased fatigue strength and toughness. Preferably, in the above range, the steel composition may be imparted with substantially improved strength and ductility.

Silicon (Si) as used herein may be included in an amount of about 1.3 to 2.3% by weight. When a solid solution is formed in ferrite with iron, silicon may increase strength and temper softening resistance. When the silicon content is less than about 1.3% by weight, the steel composition may have reduced temper softening resistance. On the other hand, when the silicon content is greater than about 2.3% by weight, decarburizing may occur upon heat treatment.

Manganese (Mn) as used herein may be included in an amount of about 0.5 to 1.2% by weight. When a solid solution is formed in the matrix, manganese may improve bending fatigue strength and quenching properties. When the manganese content is less than about 0.5% by weight, manganese may not have sufficient quenching properties. When the manganese content is greater than about 1.2% by weight, toughness may deteriorate.

Chromium (Cr) as used herein may be included in an amount of about 0.6 to 1.2% by weight. Chrome may induce the formation of carbide deposits, improve toughness, improve hardenability upon tempering, and increase strength by suppressing softening. In addition, chromium may improve toughness of the steel composition through microstructural refinement. When the chromium content is of about 0.6% by weight or greater, chromium may improve temper softening, decarburizing, quenching, and corrosion resistance. When the content of chromium is greater than about 1.2% by weight, excessively large grain boundary carbides may be formed, thereby deteriorating strength and increase in brittleness.

Molybdenum (Mo) as used herein may be included in an amount of about 0.1 to 0.5% by weight. Like Cr, molybdenum may form microstructural carbide deposits to improve strength and fracture toughness. Particularly, the uniform formation of about 1 to 5 nm of titanium molybdenum carbide (TiMoC) may improve tempering resistance and ensure thermal resistance and high strength. When the content thereof is less than about 0.1% by weight, molybdenum may not form carbides, thereby failing to obtain sufficient strength. On the other hand, when a molybdenum content is greater than about 0.5% by weight, manufacturing cost may not be efficient since the carbide deposits and the strength improvement effects are already saturated.

Nickel (Ni) as used herein may be included in an amount of 0.05 to 0.8% by weight. Nickel may improve corrosion resistance of steel and further improve thermal resistance, cold shortness, hardenability, dimensional stability, and settability. When the nickel content is less than about 0.05% by weight, the steel composition may deteriorate in corrosion resistance and high-temperature stability. On the other hand, the steel composition may undergo red shortness when the nickel content is greater than about 0.8% by weight.

Vanadium (V) as used herein may be included in an amount of about 0.05 to 0.5% by weight. Vanadium may improve micro structural refinement, tempering resistance, dimensional stability, and settability, and brings about thermal resistance and high strength. In addition, it may form a microstructural deposit VC to increase fractural toughness. Particularly, the microstructural deposit vanadium carbide (VC) may restrain the migration of grain boundaries. V may be dissolved upon austenitizing to form a solid solution, and be deposited upon tempering thereby causing secondary hardening. When the vanadium content is less than about 0.05% by weight, the fractural toughness may not be prevented from decreasing. When vanadium is used in an amount greater than about 0.5% by weight, the steel composition may contain coarse deposits and decrease in strength after quenching.

Niobium (Nb) as used herein may be included in an amount of about 0.05 to 0.5% by weight. Niobium may induce microstructural refinement, harden the steel surface through nitrization, and improve dimensional stability and settability. The formation of niobium carbide (NbC) may increase the steel strength and control the formation rates of other carbides (e.g. CrC, VC, TiC, MoC). When the niobium content is less than about 0.05% by weight, the steel composition may decrease in strength and may have a non-uniform distribution of the carbide. When the niobium content is greater than about 0.5% by weight, the formation of other carbides may be restrained.

Titanium (Ti) as used herein may be included in an amount of about 0.05 to 0.3% by weight. Like Nb, and Al, titanium may prevent or restrain grain recrystallization and growth. In addition, titanium may form nanocarbides such as titanium carbide (TiC), titanium molybdenum carbide (TiMoC), and the like and may react with nitrogen to form titanium nitride (TiN), which may restrain grain growth. Further, it may form titanium boride ($TiB_2$), which may interfere with binding between B and N, with the consequent minimization of the BN-induced quenching property degradation. When the titanium content is less than about 0.05% by weight, other inclusions such as $Al_2O_3$ may be formed, thus decreasing fatigue endurance. When the titanium content is greater than about 0.3% by weight, other alloy elements may be interfered and costs may increase.

Cobalt (Co) as used herein may be included in an amount of about 0.01 to 3% by weight. Cobalt may improve processability and restrain carbide formation in steel. Also, cobalt may suppress the growth of grains at high temperatures, and increase quenching properties, high-temperature strength, and thermal stability. When the cobalt content is less than about 0.01% by weight, the steel composition may have reduced processability and thermal stability. When the cobalt content is greater than about 3% by weight, other alloy elements may be interfered and costs may increase.

Zirconium (Zr) as used herein may be included in an amount of about 0.001 to 0.2% by weight. Zirconium may form deposits and remove N, O, and S. In addition, Zr may prolong the longevity of the steel composition and may reduce the size of non-metallic inclusions. When the Zr content is less than about 0.001% by weight, the non-metallic inclusions may increase in size without the formation of the carbide. When the Zr content greater than about 0.2%, $ZrO_2$ may be excessively formed in which may reduce cost efficiency, since the strength improvement effect is already maximally achieved.

Yttrium (Y) as used herein may be included in an amount of about 0.01 to 1.5% by weight. Yttrium may increase high-temperature stability and improve thermal resistance and toughness. When the alloy is exposed to high temperatures, yttrium may form an oxide preventive of oxidation and corrosion on the surface of the alloy thereby improving burning resistance and chemical resistance. When the yttrium content is less than about 0.01% by weight, the high-temperature stability may be deteriorated. On the other hand, when the yttrium content is greater than about 1.5% by weight, production cost may increase, solderability may be reduced, and non-uniformity may occur during steel making.

Copper (Cu) as used herein may be included in an amount of about 0.3% by weight or less but great than 0% by weight. Copper may increase quenching properties and strength after tempering, and, like Ni, improve the corrosion resistance of the steel composition. The copper content may be advantageously limited to 0.3% by weight or less since excess copper increases production costs.

Aluminum (Al) as used herein may be included in an amount of about 0.3% by weight or less but greater than 0% by weight. Aluminum may form aluminum nitride (AlN) with nitrogen to induce the refinement of austenite and improve strength and impact toughness. Particularly, the addition of aluminum together with Nb, Ti, and Mo may reduce the amount of expensive elements, including vanadium for microstructural refinement and nickel for toughness improvement. However, the content of aluminum may be limited to 0.3% by weight or less since an excess of aluminum weakens the steel composition.

Nitrogen (N) as used herein may be included in an amount of about 0.03% by weight or less but greater than 0% by weight. Nitrogen may form aluminum nitride (AlN) and titanium nitride (TiN) with Al and Ti, respectively, thereby providing microstructural refinement. Particularly, TiN may improve the quenching property of boron. However, the nitrogen content may be advantageously limited to 0.03% by weight or less since an excess of nitrogen reacts with boron, with the consequent reduction of quenching properties.

Oxygen (O) as used herein may be included in an amount of about 0.003% by weight or less but greater than 0% by weight. Oxygen may bind to Si or Al to form non-metallic, oxide-based inclusions, thereby inducing a decrease in fatigue life property. Hence, a less amount of oxygen may provide better effects. In this invention, an oxygen content may be limited to 0.003% by weight.

In addition to the aforementioned components, the spring steel may comprise iron (Fe) constituting the remaining balance of the steel composition.

EXAMPLE

Below, a detailed description will be given with reference to Examples and Comparative Examples.

The spring steels of Examples and Comparative Examples were made under conditions suitable for the production of commercially available spring steels. Wire rods from molten steels in which components were used at various contents, as shown in the following Table 1, were prepared into steel wires through consecutive processes of isothermal treatment, wire drawing, quenching-tempering, and solder quenching. Briefly, the wire rods were maintained at a temperature of 940-960° C. for 3-5 min, cooled to a temperature of 640-660° C. and maintained at that temperature for 2-4 min, followed by cooling to a temperature of 18-22° C. for 0.5-1.5 min. This isothermal treatment was adapted to facilitate the subsequent wire drawing process. Through the thermal treatment, pearlite was formed in the wire rods.

TABLE 1

| wt. % | C | Si | Mn | Cr | Mo | Ni | V | Nb | Ti | Co | Zr | Y | Cu | Al | N | O |
|---|---|---|---|---|---|---|---|---|---|---|---|---|---|---|---|---|
| Conventional (SUPM12C) | 0.55 | 1.45 | 0.68 | 0.71 | — | 0.23 | 0.08 | — | 0.03 | — | — | | 0.23 | 0.035 | — | — |
| Ex. 1 | 0.56 | 1.52 | 0.64 | 0.9 | 0.13 | 0.31 | 0.16 | 0.07 | 0.06 | 0.03 | 0.19 | 0.015 | 0.052 | 0.009 | 0.001 | 0.0005 |
| Ex. 2 | 0.43 | 2.29 | 0.73 | 0.65 | 0.32 | 0.06 | 0.48 | 0.21 | 0.18 | 1.47 | 0.0015 | 1.47 | 0.065 | 0.014 | 0.0013 | 0.001 |
| Ex. 3 | 0.88 | 1.85 | 1.16 | 1.15 | 0.46 | 0.78 | 0.05 | 0.49 | 0.29 | 2.94 | 0.018 | 0.89 | 0.045 | 0.012 | 0.0016 | 0.0011 |
| C. Ex. 1 | 0.58 | 1.52 | 0.65 | 0.93 | 0.08 | 0.34 | 0.14 | 0.07 | 0.09 | 0.04 | 0.11 | 0.09 | 0.053 | 0.005 | 0.0014 | 0.0007 |
| C. Ex. 2 | 0.67 | 2.27 | 0.76 | 0.75 | 0.51 | 0.75 | 0.17 | 0.23 | 0.17 | 1.15 | 0.13 | 1.26 | 0.035 | 0.012 | 0.0015 | 0.0009 |
| C. Ex. 3 | **0.8** | **1.8** | **1.19** | **1.16** | **0.46** | **0.04** | **0.44** | **0.46** | **0.25** | **1.45** | **0.16** | **0.57** | **0.041** | **0.013** | **0.0016** | **0.0011** |
| C. Ex. 4 | **0.53** | **1.597** | **0.67** | **0.86** | **0.13** | **0.82** | **0.38** | **0.06** | **0.16** | **1.74** | **0.17** | **0.85** | **0.055** | **0.006** | **0.0012** | **0.0008** |
| C. Ex. 5 | 0.66 | 2.19 | 0.73 | 0.74 | 0.32 | 0.36 | 0.04 | 0.22 | 0.14 | 0.08 | 0.06 | 1.35 | 0.066 | 0.015 | 0.0011 | 0.0005 |
| C. Ex. 6 | 0.88 | 1.79 | 1.13 | 1.15 | 0.44 | 0.75 | 0.52 | 0.46 | 0.25 | 2.53 | 0.09 | 0.017 | 0.043 | 0.013 | 0.0012 | 0.0007 |
| C. Ex. 7 | **0.69** | **2.29** | **0.72** | **0.79** | **0.11** | **0.36** | **0.48** | **0.03** | **0.09** | **1.84** | **0.16** | **0.36** | **0.045** | **0.009** | **0.001** | **0.0005** |
| C. Ex. 8 | **0.82** | **1.86** | **1.11** | **1.17** | **0.36** | **0.74** | **0.18** | **0.51** | **0.14** | **2.96** | **0.009** | **0.44** | **0.053** | **0.014** | **0.0013** | **0.001** |
| C. Ex. 9 | 0.47 | 1.56 | 0.67 | 0.96 | 0.15 | 0.36 | 0.15 | 0.23 | 0.04 | 0.97 | 0.07 | 0.08 | 0.081 | 0.012 | 0.0016 | 0.0011 |
| C. Ex. 10 | 0.69 | 2.26 | 0.77 | 0.76 | 0.36 | 0.71 | 0.46 | 0.15 | 0.32 | 2.95 | 0.15 | 1.35 | 0.041 | 0.005 | 0.0014 | 0.0007 |
| C. Ex. 11 | 0.63 | 1.48 | 0.86 | 0.75 | 0.15 | 0.37 | 0.43 | 0.46 | 0.08 | **0.009** | 0.007 | 0.28 | 0.066 | 0.012 | 0.0015 | 0.0009 |
| C. Ex. 12 | **0.65** | **1.84** | **1.16** | **1.18** | **0.35** | **0.7** | **0.32** | **0.08** | **0.11** | **3.03** | **0.19** | **1.49** | **0.083** | **0.013** | **0.0016** | **0.0011** |
| C. Ex. 13 | **0.5** | **1.93** | **0.99** | **0.98** | **0.18** | **0.37** | **0.45** | **0.25** | **0.12** | **0.41** | **0.0009** | **0.015** | **0.042** | **0.006** | **0.0012** | **0.0008** |
| C. Ex. 14 | 0.55 | 1.67 | 0.75 | 0.77 | 0.36 | 0.71 | 0.46 | 0.15 | 0.26 | 0.17 | **0.21** | 0.79 | 0.051 | 0.015 | 0.0011 | 0.0005 |
| C. Ex. 15 | 0.64 | 1.45 | 0.85 | 0.74 | 0.47 | 0.38 | 0.34 | 0.24 | 0.23 | 1.63 | 0.168 | **0.008** | 0.065 | 0.009 | 0.0012 | 0.0007 |
| C. Ex. 16 | 0.69 | 1.86 | 1.14 | 1.13 | 0.49 | 0.35 | 0.49 | 0.29 | 0.27 | 0.06 | 0.046 | **1.52** | 0.053 | 0.014 | 0.001 | 0.0005 |

After the isothermal treatment, the wire rods were subjected to various steps of wire drawing to achieve a target wire diameter. In the present invention, wire rods having a diameter of 4 mm were drawn.

The drawn wire rods were heated to and maintained at a temperature of 940-960° C. for 3-5 minutes, and quenched to a temperature of 45-55° C., followed by tempering for 0.5-1.5 minutes. Thereafter, the wire rods were again heated to a temperature of 440-460° C. and maintained for 2 to 4 minutes, and then subjected to solder quenching. The formation of martensite by quenching and tempering imparted strength to the wire rods while the formation of tempered martensite by solder quenching imparted strength and toughness.

In Test Examples, an examination was made of the physical properties of the spring steels of Examples and Comparative Examples.

The spring steels of Examples and Comparative Examples were tested for tensile strength, hardness, fatigue life of wire rods, corrosion pit depth, single corrosion fatigue life, complex corrosion fatigue life, and improvement in carbon fraction and carbon activity, and the results are given in the following Table 2.

TABLE 2

| | Tensile Strength (MPa) | Hardness (HV) | Wire Rod Fagigue life (cycles) | Corrosion pit depth (μm) | Single Corrosion Fatigue Life (Salt Spray + Fatigue) (cycles) | Complex Corrosion Fatigue Life (ES Complex Corrosion) (cycles) | Carbonfraction >7% Carbon Activity >3% |
|---|---|---|---|---|---|---|---|
| Conventional (SUPM12C) | 1960 | 570 | 220,000 | 24 | 17,000 | 275,000 | X |
| Ex. 1 | 2205 | 720 | 327,000 | 11 | 32,000 | 405,000 | ○ |
| Ex. 2 | 2210 | 735 | 345,000 | 14 | 29,000 | 412,000 | ○ |
| Ex. 3 | 2225 | 742 | 353,000 | 13 | 30,000 | 420,000 | ○ |
| C. EX. 1 | 2020 | 615 | 170,000 | 25 | 18,000 | 256,000 | X |
| C. EX. 2 | 1985 | 586 | 250,000 | 28 | 15,000 | 245,000 | ○ |
| C. EX. 3 | 1850 | 605 | 200,000 | 26 | 14,000 | 263,000 | ○ |
| C. EX. 4 | 1775 | 564 | 240,000 | 24 | 20,000 | 255,000 | ○ |
| C. EX. 5 | 2010 | 601 | 190,000 | 26 | 23,000 | 247,000 | X |
| C. EX. 6 | 2015 | 622 | 230,000 | 29 | 18,000 | 283,000 | ○ |
| C. EX. 7 | 2035 | 633 | 250,000 | 28 | 22,000 | 244,000 | X |
| C. EX. 8 | 2025 | 642 | 220,000 | 29 | 22,000 | 279,000 | ○ |
| C. EX. 9 | 2075 | 662 | 180,000 | 21 | 19,000 | 287,000 | X |
| C. EX. 10 | 1820 | 651 | 170,000 | 20 | 18,000 | 285,000 | ○ |
| C. EX. 11 | 1840 | 573 | 220,000 | 25 | 15,000 | 291,000 | ○ |
| C. EX. 12 | 1750 | 565 | 210,000 | 24 | 14,000 | 295,000 | ○ |
| C. EX. 13 | 2000 | 616 | 200,000 | 23 | 18,000 | 281,000 | ○ |

TABLE 2-continued

| | Tensile Strength (MPa) | Hardness (HV) | Wire Rod Fagigue life (cycles) | Corrosion pit depth (μm) | Single Corrosion Fatigue Life (Salt Spray + Fatigue) (cycles) | Complex Corrosion Fatigue Life (ES Complex Corrosion) (cycles) | Carbonfraction >7% Carbon Activity >3% |
|---|---|---|---|---|---|---|---|
| C. EX. 14 | 2010 | 624 | 200,000 | 28 | 23,000 | 249,000 | X |
| C. EX. 15 | 2040 | 635 | 170,000 | 29 | 26,000 | 264,000 | ○ |
| C. EX. 16 | 1955 | 595 | 190,000 | 23 | 15,000 | 285,000 | ○ |

In this regard, tensile strength was measured using a 20-ton tester on specimens with a diameter of 4 mm according to KS B 0802, and hardness was measured using a micro Vickers hardness tester at 300 gf according to KS B 0811.

Fatigue life was measured by performing a rotary bending fatigue test on specimens with a diameter of 4 mm according to KS B ISO 1143. L10 life, referred to as "basic rating life", was defined as the lifetime associated with 90% reliability when operating under conventional conditions, and was expressed by round numbers in multiples of one million. The 10 percent life was approximately one-seventh of the L50 mean life or mean time between failures. Corrosion fatigue life was measured using a salt spray test (KS D 9502, ISO 3768/7263).

Improvements in carbon fraction and carbon activity were calculated using ThermoCalc with reference to thermodynamic databases. Particularly, the carbon fraction was measured through counting on SEM-EDX elemental maps.

As is understood from the data of Table 2, the conventional steel that lacked Mo, Ni, V, Nb, Ti, Co, Zr, and Y did not meet any of the requirements of the present invention for tensile strength, hardness, fatigue life of wire rods, corrosion pit depth, single corrosion fatigue life, complex corrosion fatigue life, and improvement in carbon fraction and carbon activity.

The steels of Comparative Examples 1 to 16 were different in component content from those according to the present invention, and failed to meet any of the requirements of the present invention, although improving somewhat in tensile strength, hardness, fatigue life of wire rods, corrosion pit depth, single corrosion fatigue life, complex corrosion fatigue life, and improvement in carbon fraction and carbon activity.

Failing to acquire sufficient tensile strength, particularly, the steel of Comparative Example 1, which included less amount of Mo, did not secure sufficient tensile strength, and was deteriorated in the fatigue life of wire rods and complex corrosion fatigue life and aggravated in corrosion pit depth, compared to the conventional steel.

In Comparative Examples 3 and 11, each of the Ni and the Co content was less than the predetermined amounts in the present invention. The steels rather decreased in single corrosion fatigue life, compared to the conventional steel. Further, a deeper corrosion pit was found in the steels of Comparative Examples 3 and 11.

Each of Comparative Examples 13 to 16 did not meet the requirements for Zr and Y contents. The steels were observed to reduce in the fatigue life of wire rods, compared to the conventional steel. When the Zr content was greater than the requirement like Comparative Example 14 or when the content Y was less than the requirement like Comparative Example 15, deeper corrosion pits were detected while the complex corrosion fatigue life was reduced.

On the other hand, all of the steels of Examples 1 to 3 that satisfied the predetermined ranges in the present invention showed a tensile strength of 2100 MPa or greater and a hardness of 700 HV or greater. In addition, corrosion pits with a depth of 15 μm or less were measured in the steels. They were found to have a fatigue life over 280,000 cycles as measured by a bending fatigue test, 28,000 cycles as measured by a single corrosion fatigue test, and 400,000 cycles as measured by a complex corrosion fatigue test. Also, they improved in carbon fraction by 7% or greater and in carbon activity by 3% or greater, compared to the conventional steel.

Figure 2:
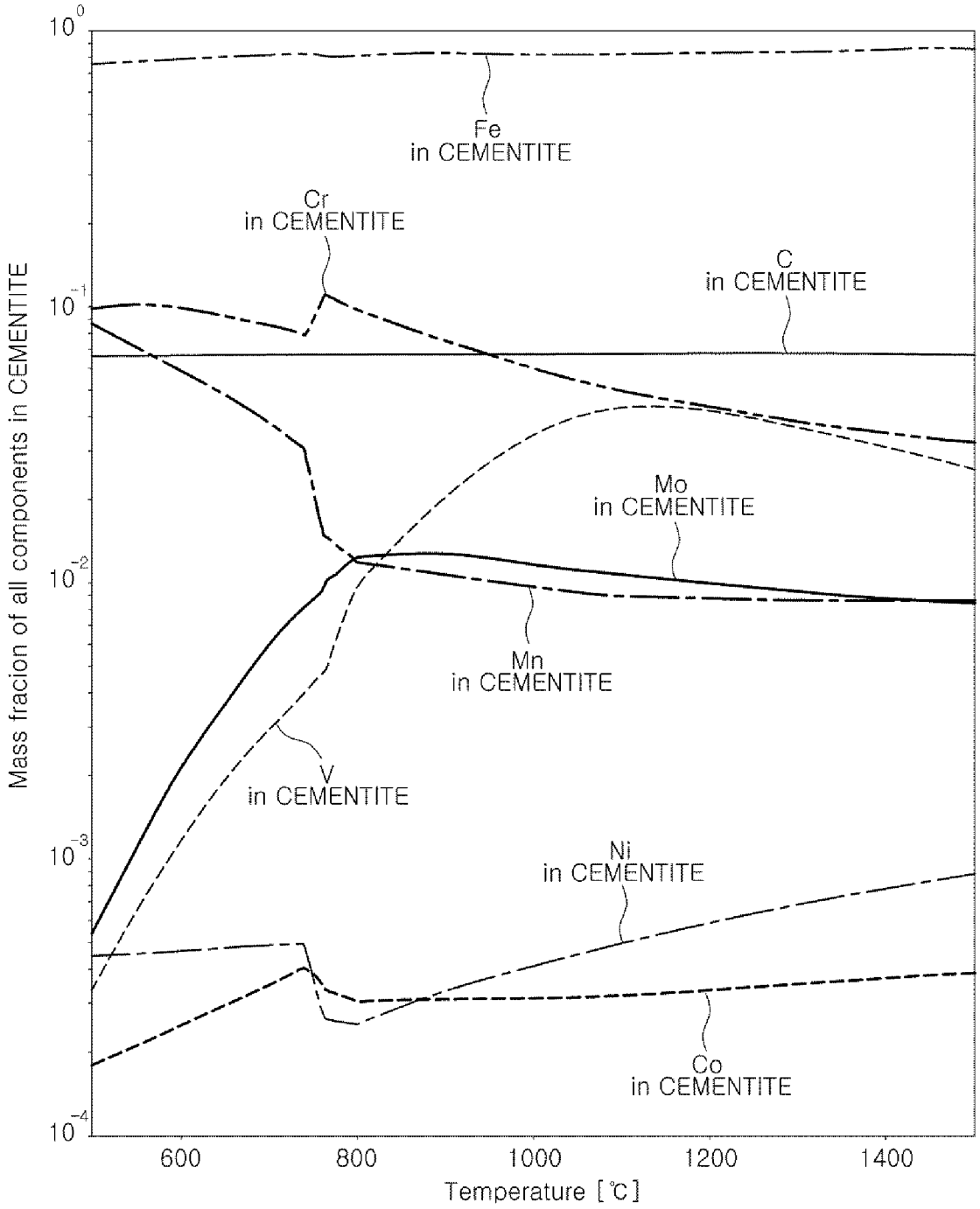
FIG. 2 is a graph showing the phase transformation into cementite based on a temperature change for an exemplary steel according to an exemplary embodiment of the present invention.

FIG. 1 is a graph showing the phase transformation of an exemplary high-strength spring steel against temperature according to an exemplary embodiment of the present invention, and FIG. 2 is a graph showing the phase transformation into cementite against temperature of an exemplary high-strength spring steel according to an exemplary embodiment of the present invention.

In FIG. 1, the phase transformation of a steel composition having an alloy composition of Fe-1.5Si-0.7Mn-0.8Cr-0.3Ni-0.3Mo-0.3V-0.1Nb-0.15Ti-0.1Co-0.1Zr-0.1Y-0.55C is shown against temperature. Given the alloy composition of the present invention, as shown in FIG. 1, the steel may have various microinclusions such as CrC and VC, as well as Ti-rich or Zr-rich carbides formed during solidification, and thus was expected to be improved in strength and fatigue life.

In FIG. 2, the phase transformation of an exemplary steel having an alloy composition of Fe-1.5Si-0.7Mn-0.8Cr-0.3Ni-0.3Mo-0.3V-0.1Nb-0.15Ti-0.1Co-0.1Zr-0.1Y-0.55C in cementite is shown against temperature. As shown in FIG. 2, it is understood that the complex behavior of octonary elements in cementite occurred, thus predicting the uniform distribution of microcarbides.

As described hitherto, the steel of the present invention may be provided with a tensile strength of about 21,000 MPa or greater by optimizing contents of main alloy components and improved in corrosion resistance and complex corrosion fatigue life by about 50% or greater through inclusion refinement.

Although the various exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A spring steel comprising:

a steel composition comprising:

carbon (C) in an amount of about 0.4 to 0.9% by weight;

silicon (Si) in an amount of about 1.3 to 2.3% by weight;

manganese (Mn) in an amount of about 0.5 to 1.2% by weight;

chromium (Cr) in an amount of about 0.6 to 1.2% by weight;

molybdenum (Mo) in an amount of about 0.1 to 0.5% by weight;

nickel (Ni) in an amount of about 0.05 to 0.8% by weight;

vanadium (V) in an amount of about 0.05 to 0.5% by weight;

niobium (Nb) in an amount of about 0.05 to 0.5% by weight;

titanium (Ti) in an amount of about 0.05 to 0.3% by weight;

cobalt (Co) in an amount of about 0.01 to 3% by weight;

zirconium (Zr) in an amount of about 0.001 to 0.2% by weight;

yttrium (Y) in an amount of 0.89 to 1.5% by weight;

copper (Cu) in an amount of about 0.3% by weight or less but greater than 0% by weight;

aluminum (Al) in an amount of about 0.3% by weight or less but greater than 0% by weight;

nitrogen (N) in an amount of about 0.03% by weight or less but greater than 0% by weight;

oxygen (O) in an amount of about 0.003% by weight or less but greater than 0% by weight; and balance iron (Fe), all the % by weights are based on the total weight of the steel composition, wherein martensite is formed in the spring steel, wherein the spring steel has a tensile strength of about 2100 MPa or greater, and wherein the spring steel has a hardness of about 700 HV or greater.

2. The spring steel of claim 1, wherein the spring steel has a corrosion pit depth of about 15 μm or less.

3. The spring steel of claim 1, wherein the spring steel has a fatigue lifetime of about 280,000 cycles or greater as measured by a bending fatigue test.

4. The spring steel of claim 1, wherein the spring steel has a fatigue lifetime of about 28,000 cycles or greater as measured by a single corrosion fatigue life test.

5. The spring steel of claim 1, wherein the spring steel has a fatigue lifetime of about 400,000 cycles or greater as measured by a complex corrosion fatigue test.

6. A vehicle part comprising the spring steel of claim 1.

7. The vehicle part of claim 6, wherein the spring steel used in a suspension system in a vehicle.

* * * * *